US006488402B1

(12) United States Patent
King et al.

(10) Patent No.: US 6,488,402 B1
(45) Date of Patent: Dec. 3, 2002

(54) STEAM INJECTOR AND TANK MIXER

(75) Inventors: Leonard Tony King, Long Bch, CA (US); Richard Carlson, Palos Verdes Est., CA (US)

(73) Assignee: Komax Systems, Inc., Wilmington, CA (US)

( * ) Notice: Subject to any disclaimer, the term of this patent is extended or adjusted under 35 U.S.C. 154(b) by 0 days.

(21) Appl. No.: 09/823,812

(22) Filed: Mar. 30, 2001

(51) Int. Cl.[7] ..... B01F 5/04

(52) U.S. Cl. ..... 366/173.2; 366/181.4; 366/181.5; 366/336

(58) Field of Search ..... 366/173.2, 165.1, 366/169.1, 173.1, 174.1, 175.2, 177.1, 336, 337, 338, 339, 181.4, 181.5, 181.6

(56) References Cited

U.S. PATENT DOCUMENTS 1,156,946 A * 10/1915 Vandercook
1,192,478 A * 7/1916 Vandercook
1,992,261 A * 2/1935 Traudt ..... 366/173.2
2,582,198 A * 1/1952 Etheridge
2,647,732 A * 8/1953 Jarman ..... 366/165.5
2,906,607 A * 9/1959 Jamison ..... 366/173.2
3,586,294 A * 6/1971 Strong
3,861,652 A * 1/1975 Clark et al. ..... 366/336
3,871,272 A * 3/1975 Melandri ..... 366/137
4,050,676 A * 9/1977 Morishima et al. ..... 366/339
4,097,026 A * 6/1978 Haindl
4,616,937 A * 10/1986 King ..... 366/336
4,824,614 A * 4/1989 Jones ..... 366/338
5,076,705 A * 12/1991 Brickhouse et al. ..... 366/337
5,421,408 A * 6/1995 Stoisits et al.
5,670,093 A * 9/1997 Payne
6,109,778 A * 8/2000 Wilmer ..... 366/173.2

* cited by examiner

*Primary Examiner*—Tony G. Soohoo
(74) *Attorney, Agent, or Firm*—Malcolm B. Wittenberg; Dergosits & Noah LLP

(57) ABSTRACT

A device for the injection and mixing of steam into a tank containing a fluid such as water. A primary steam conduit receives steam and discharges it into a plurality of secondary steam conduits. The primary steam conduit is provided with at least one mixing element for inducing an angular velocity to the steam passing through it. A plurality of secondary steam conduits are provided for receiving steam from the primary steam conduit and for discharging steam into the fluid contained in the tank. Each secondary steam conduit is also provided with at least one mixing element proximate the discharge ends of the secondary steam conduits wherein all such mixing elements induce a rotational angular velocity to the steam.

10 Claims, 3 Drawing Sheets

STEAM INJECTOR AND TANK MIXER

TECHNICAL FIELD OF THE INVENTION

The present invention involves a device for the injection and mixing of steam into a tank containing a fluid such as water. Through the use of the present invention, one is able to achieve more efficient heat transfer than is otherwise available from competing devices. In addition, the present invention, being of a motionless design, requires less maintenance than competitive steam injection apparatus.

BACKGROUND OF THE INVENTION

Steam injection has been a unit operation carried out by chemical engineers in processing facilities for as long as chemical engineering has been a science. For example, a typical steam injection water heater was disclosed in U.S. Pat. No. 2,455,498. Subsequently, U.S. Pat. No. 3,984,504 dealt with the fabrication of a rather complex device used to eliminate water hammer which has characterized steam injection systems in the past. It was recognized that such heaters work satisfactorily at relatively low steam pressure such as pressures below 300 psi. At high steam pressures, however, water hammer develops due to the sudden collapse of relatively large steam bubbles which are created by the high pressure steam as it condenses in water.

Steam injection is known as a preferred means of heating water both in a moving stream and in a tank during batch unit operations. There are, however, certain limitations in promoting effective heat transfer between a volume of steam and a fluid contained within a tank. Specifically, steam injection is carried out by introducing a volume of steam within a tank where the steam creates bubbles at relatively high temperature which rise to the surface of a standing fluid only to escape into the surrounding atmosphere. This provides for relatively poor heat transfer and heat distribution. The latter consideration is of principal importance in employing steam to raise the temperature of a large body of fluid where areas within the tank remote from points of steam injection remain at relatively low temperatures. Further, when dealing with an open tank at standard atmospheric pressures, one cannot hope to approach the ideal 212° F., the temperature of boiling water. In fact, in most such installations, raising the temperature of the fluid to 140° F. is considered a significant achievement. By practicing the present invention, one can achieve uniform temperatures in the vicinity of 190° F.

It is thus an object of the present invention to provide a steam injector device which more efficiently distributes thermal energy than devices of the prior art.

It is yet a further object of the present invention to provide a steam injector device without any moving parts in order to reduce operating costs and down time.

These and further objects of the present invention will be more readily appreciated when considering the following disclosure and appended claims.

SUMMARY OF THE INVENTION

The present invention is directed to a device for the injection and mixing of steam into a tank containing a fluid. The device comprises a primary steam conduit for receiving steam and for discharging it into a plurality of secondary steam conduits. The primary steam conduit is provided with at least one mixing element positioned therein for inducing an angular velocity to the steam passing through the primary steam conduit. A plurality of secondary steam conduits are provided for receiving steam from the primary steam conduit at their upstream ends and for discharging steam into the tank containing fluid at their downstream ends. Each secondary steam conduit is provided with at least one mixing element proximate its downstream end wherein all such mixing elements induce a rotational angular velocity to the steam exiting said downstream ends.

DETAILED DESCRIPTION OF THE INVENTION

Figure 1:
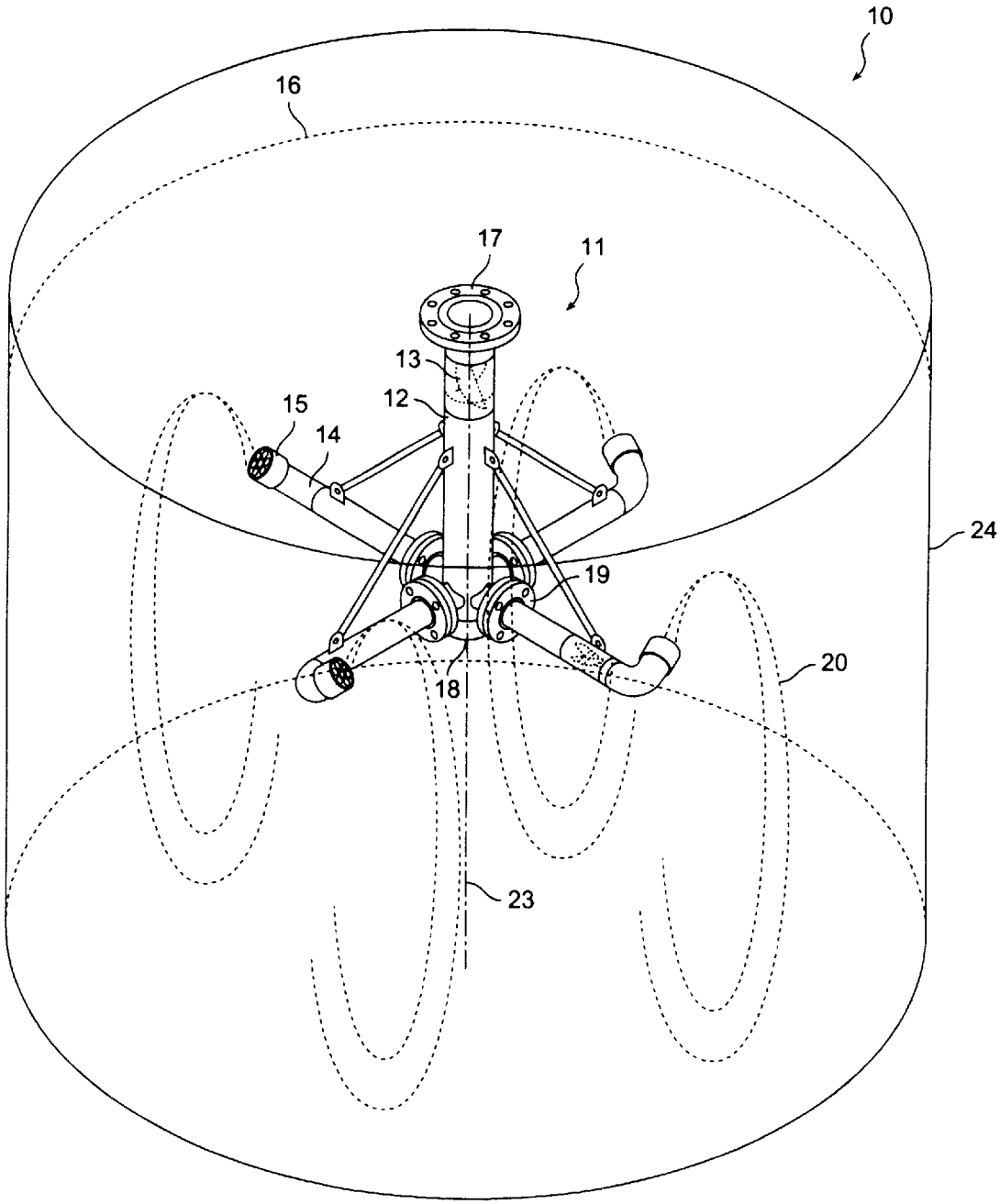
FIG. 1 is a perspective view of a preferred embodiment of the present invention.

Turning to FIG. 1, device 11 is shown situated within tank 10 and partially submerged within a fluid such as water being at a fluid level 16 within tank 10. The device is intended to inject steam within the fluid contained within tank 10 by mixing the steam as discussed hereinafter in order to more evenly distribute thermal energy from the steam and to transfer it to the fluid.

Injection and mixing device 11 is shown as having primary steam conduit 12 in the form of a tubular member having a substantially circular cross-section and longitudinal axis 18. Ideally, tank 10 is provided with curved side wall 24 of a cylindrical shape. As such, the cross-sectional geometry of tank 10 is ideally substantially circular and, again, as a preferred embodiment, longitudinal axis 18 of primary steam conduit 12 is located at the geometric center of tank 10 defined by longitudinal axis 23.

Steam enters primary steam conduit 12 at upstream end 17. Steam entering upstream end 17 is confronted with mixing element 13 capable of inducing an angular velocity to steam passing through primary steam conduit 12.

A plurality of secondary steam conduits 14 are provided for receiving steam from primary steam conduit 12 at their upstream ends and for discharging steam into the fluid contained within tank 10 at their downstream ends. Each secondary steam conduit 14 is provided with at least one mixing element 15 proximate their downstream ends wherein all such mixing elements induce a rotational angular velocity to the steam exiting said downstream ends of the same sign.

Figure 4:
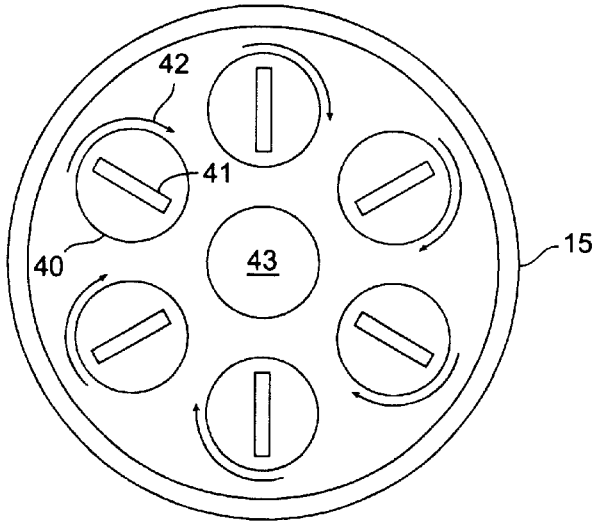
FIG. 4 is a plan view of a mixing element of a preferred design located at the downstream end of each secondary steam conduit.

It is noted that, as a preferred embodiment, each of the mixing elements 15 positioned proximate the downstream ends of the secondary steam conduits are in the shape of the secondary steam conduits, each having a plurality of openings housing an individual mixing element each of which induces a rotational angular velocity of the same sign to the steam passing therethrough. In this regard, reference is made to FIG. 4 wherein material mixing apparatus 15 is shown. As a preferred embodiment, material mixing apparatus 15 is in the shape of secondary steam conduit 14 and includes a plurality of openings 40 each housing a mixing element 41 which induces a rotational angular velocity to steam passing therethrough in the direction of arrow 42. As a further preferred embodiment, material mixing apparatus 15 is provided with a centrally located conically shaped plug 43. The mixing elements 41 being all of the same sign produce sets of rotational vortexes of steam that impinge on each other generally enhancing mixture of the steam into fluid contained within tank 10. Although mixing elements of various designs can be employed which each accomplish the function recited above, mixing elements 41 as well as mixing element 13 can be of applicant's own design which is disclosed in U.S. Pat. No. 3,923,288, the disclosure of which is hereby incorporated by reference.

Figure 2A:
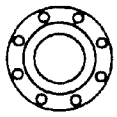
FIGS. 2 and 3 are side and top plan views of the present invention as depicted in FIG. 1.
Figure 2B:
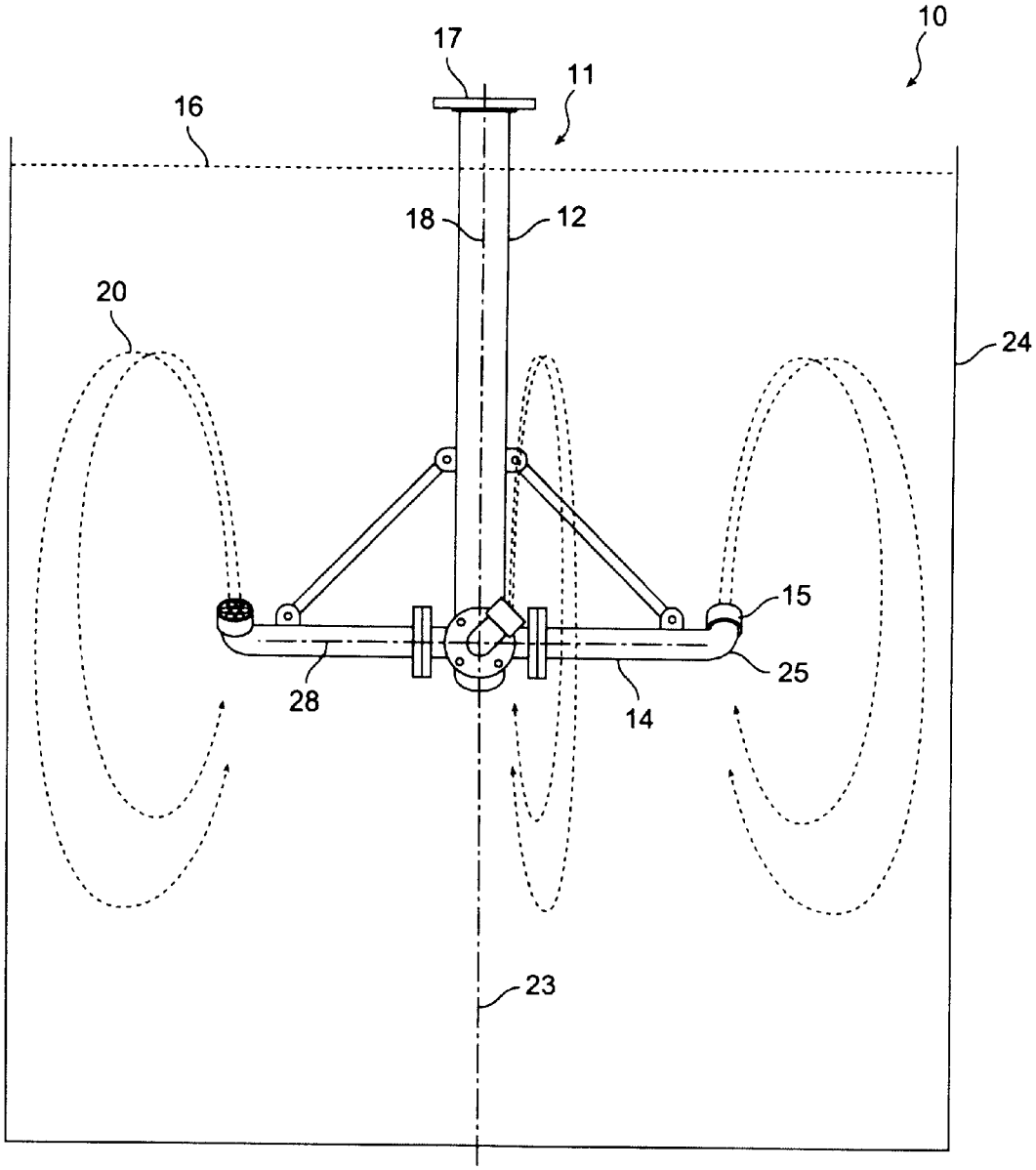
Figure 3:
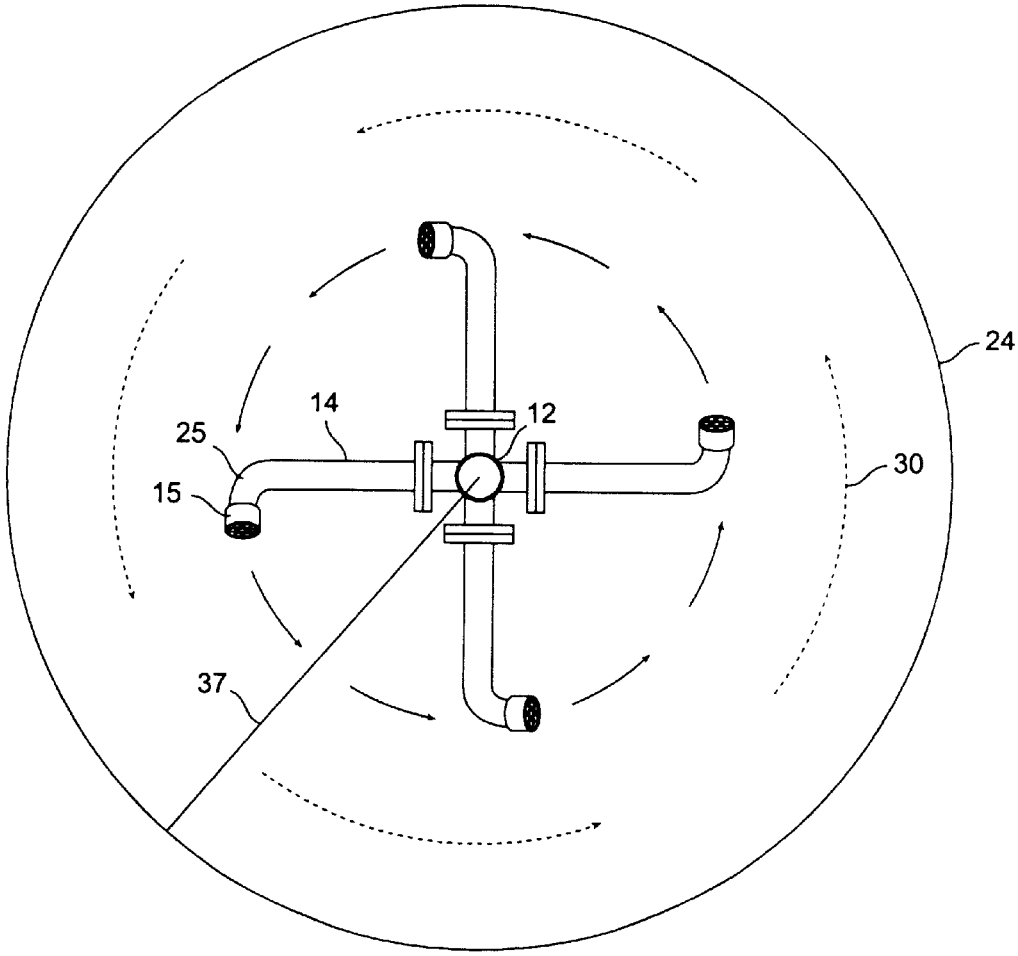

Reference is now made to FIG. 2 showing the preferred geometric relationship between primary steam conduit 12 and secondary steam conduits 14. Specifically, as noted previously, ideally, tank 10 having curved side wails 24 is in the shape of a conduit having a substantially circular cross-sectional area and centrally located longitudinal axis 23. Again, ideally, primary steam conduit 12 having its own longitudinal axis 18 is positioned within tank 10 such that longitudinal axis 18 substantially coincides with longitudinal axis 23. Further, secondary steam conduits 14 also being tubular shaped have their own longitudinal axes 28 which preferably extend perpendicularly from longitudinal axis 18. Further, ideally, injection and mixing device 11 is located within tank 10 and beneath fluid height 16 such that secondary steam conduits 14 are located approximately one-third of the height 16 of said fluid. In addition, as noted by reference to FIG. 3, secondary steam conduits 14 extend from primary steam conduit 12 to be between approximately one-quarter to one-half of tank radius 37. It is further noted by reference to FIG. 2 that, ideally, the downstream ends of secondary steam conduits 14 are angled other than 90° to longitudinal axis 23 of tank 10. Most ideally, downstream ends of secondary steam conduits 14 are angled so that steam discharged from mixing elements 15 will be at approximately 45° to longitudinal axis 23 providing a flow pattern as shown in FIGS. 1 and 2. Proximate the downstream ends of secondary steam conduits 14 is located angled conduit 25 so that steam exiting from mixing elements 15 will also be directed in a circular path 30 (FIG. 3) parallel to tank side wall 24.

By providing a steam injector and mixing apparatus as depicted and as described above, one is able to achieve a mixing efficiency unapproachable by prior art designs and which possesses no moving parts for simplicity and ease of maintenance. As noted, the present device provides for a tangential momentum component of the steam exiting each secondary steam conduit which forces the entire body of fluid contained within tank 10 to rotate about axis 23. Further, the vertical momentum component of the steam causes fluid to lift near the tank center, move to the side wall, and travel down again. These two momentum vectors generate two mixing actions for the tank product, both round and round and up and down to produce uniform heating. Mixing elements 15 inducing rotation of exiting steam of the same sign further enhance heat transfer to fluid contained within tank 10.

What is claimed is:

1. A combination of a device for the injection and mixing of steam into a tank containing fluid, said device comprising a primary steam conduit for receiving steam and for discharging it into a plurality of secondary steam conduits, said primary steam conduit having at least one mixing element positioned therein for inducing an angular velocity to the steam passing through said primary steam conduit and a plurality of secondary steam conduits for receiving steam from said primary steam conduit at their upstream ends and for discharging steam into said tank containing fluid at their downstream ends wherein each secondary steam conduit is provided with a material mixing apparatus proximate their downstream ends and wherein each material mixing apparatus positioned proximate to downstream ends of said secondary steam conduits are in the shape of said secondary steam conduits, each having a plurality of openings housing mixing elements which each induce a rotational angular velocity of the same sign to the steam passing therethrough.

2. The device of claim 1 wherein in each of said primary steam conduit and secondary steam conduits are tubular, each having a substantially circular cross-section and longitudinal axis.

3. A combination of a device for the injection and mixing of steam into a tank and a tank containing fluid, said device comprising a primary steam conduit for receiving steam and for discharging it into a plurality of secondary steam conduits, said primary steam conduit having at least one mixing element positioned therein for inducing an angular velocity to the steam passing through said primary steam conduit and a plurality of secondary steam conduits for receiving steam from said primary steam conduit at their upstream ends and for discharging said steam into said tank containing fluid at their downstream ends wherein each secondary steam conduit is provided with a material mixing apparatus proximate their downstream ends and wherein said tank is substantially cylindrical in shape having a substantially circular cross-section and radius, curved side walls and a centrally located longitudinal axis substantially parallel to said side walls.

4. The device of claim 3 wherein the longitudinal axis of said primary steam conduit is located at the longitudinal axis of said tank.

5. The the device of claim 4 wherein the longitudinal axes of said secondary steam conduits are substantially perpendicular to the longitudinal axis of said primary steam conduit.

6. The device of claim 4 wherein the downstream ends of said secondary steam conduits extend from said primary steam conduit to be between approximately one-quarter to one-half of said tank radius.

7. The device of claim 4 wherein said mixing elements located at the downstream ends of said secondary steam conduits are oriented such that steam discharged therefrom will be discharged at an angle other than 90° to the longitudinal axis of the tank.

8. The device of claim 7 wherein steam discharged from the downstream ends of said secondary steam conduits will be at approximately 45° to the longitudinal axis of the tank.

9. The device of claim 3 wherein said fluid is contained within said tank to a height along the side walls thereof.

10. The device of claim 9 wherein said secondary steam conduits are positioned within said tank to be approximately one-third of the height of said fluid.

* * * * *